United States Patent [19]

Morrow, Sr. et al.

[11] 4,011,955

[45] Mar. 15, 1977

[54] SEA CRANE TIEDOWN

[75] Inventors: James G. Morrow, Sr.; David J. Pech, both of Manitowoc, Wis.

[73] Assignee: The Manitowoc Company, Inc., Manitowoc, Wis.

[22] Filed: Mar. 29, 1976

[21] Appl. No.: 671,315

[52] U.S. Cl. ..... 212/3; 212/48; 212/70

[51] Int. Cl.[2] ..... B66C 23/52

[58] Field of Search ..... 214/132–138; 212/3, 28, 58 R, 59 R, 48, 49, 144, 66–70

[56] References Cited

UNITED STATES PATENTS

| | | | |
|---|---|---|---|
| 1,352,575 | 9/1920 | Bingaman | 212/70 |
| 2,109,304 | 2/1938 | Ormsby | 212/70 |

*Primary Examiner*—Robert J. Spar
*Assistant Examiner*—Lawrence J. Oresky
*Attorney, Agent, or Firm*—Leydig, Voit, Osann, Mayer & Holt, Ltd.

[57] ABSTRACT

A sea crane having a rotatable upper works mounted on a cylindrical pedestal with the upper works having a tiedown to the pedestal including an annular collar on the pedestal and a ring-like structure suspended from the upper works beneath the collar and mounted out of contact with both the collar and the pedestal. Tension links couple the bed of the upper works to the ring-like structure to prevent structural failure from bending the bed, or tilting and pulling the upper works either forward or backward from the pedestal.

3 Claims, 3 Drawing Figures

23
10
21
22
20
16
18
19
41
26
26
34
25
43
17
36
33
14
13
49
37
42
51
39
38
48
31
30
32
12
11

SEA CRANE TIEDOWN

This invention relates generally to load handling cranes and more particularly concerns an attachment for a sea crane.

Modern oil exploration and production have made extensive use of artificial islands or platforms located well offshore. Such oil drilling platforms typically rest on the sea bed and extend considerably above water level so as to avoid wave effects under all tidal conditions. Also typically, materials used in the operation of the platform and its machinery are lifted by load handling cranes, so called sea cranes, fixed to the platform structure.

Basically, a sea crane corresponds to the more familiar self-propelled crane configuration except that the upper works of a sea crane rotates on a roller path that is fixed on a turret or pedestal. For reasons not entirely clear, although probably having to do with being required to handle loads from relatively moving work boats, sea cranes have been subject to unexpected catastrophic loads causing the entire upper works to be torn from their mounting and pulled into the sea.

Accordingly, it is the primary aim of the invention to provide a failure containment configuration for sea cranes which would not interfere or affect normal operation but which is capable of controlling failure under loads greatly exceeding those causing that failure.

A related object of the invention is to provide a configuration of the above kind capable of controlling both direct loading failure, i.e., when boom loading tends to pull the upper works away, as well as reaction or snap back failure, i.e., as when an excessive boom load is suddenly imposed and lost, causing a violent rearward and upward swing of the boom tending to tilt the upper works rearwardly.

Another object is to provide a configuration as characterized above that is economical to manufacture and install, and which does not add additional maintenance expenses to the crane.

Other objects and advantages of the invention will become apparent upon reading the following detailed description and upon reference to the drawings, in which.

Figure 1:
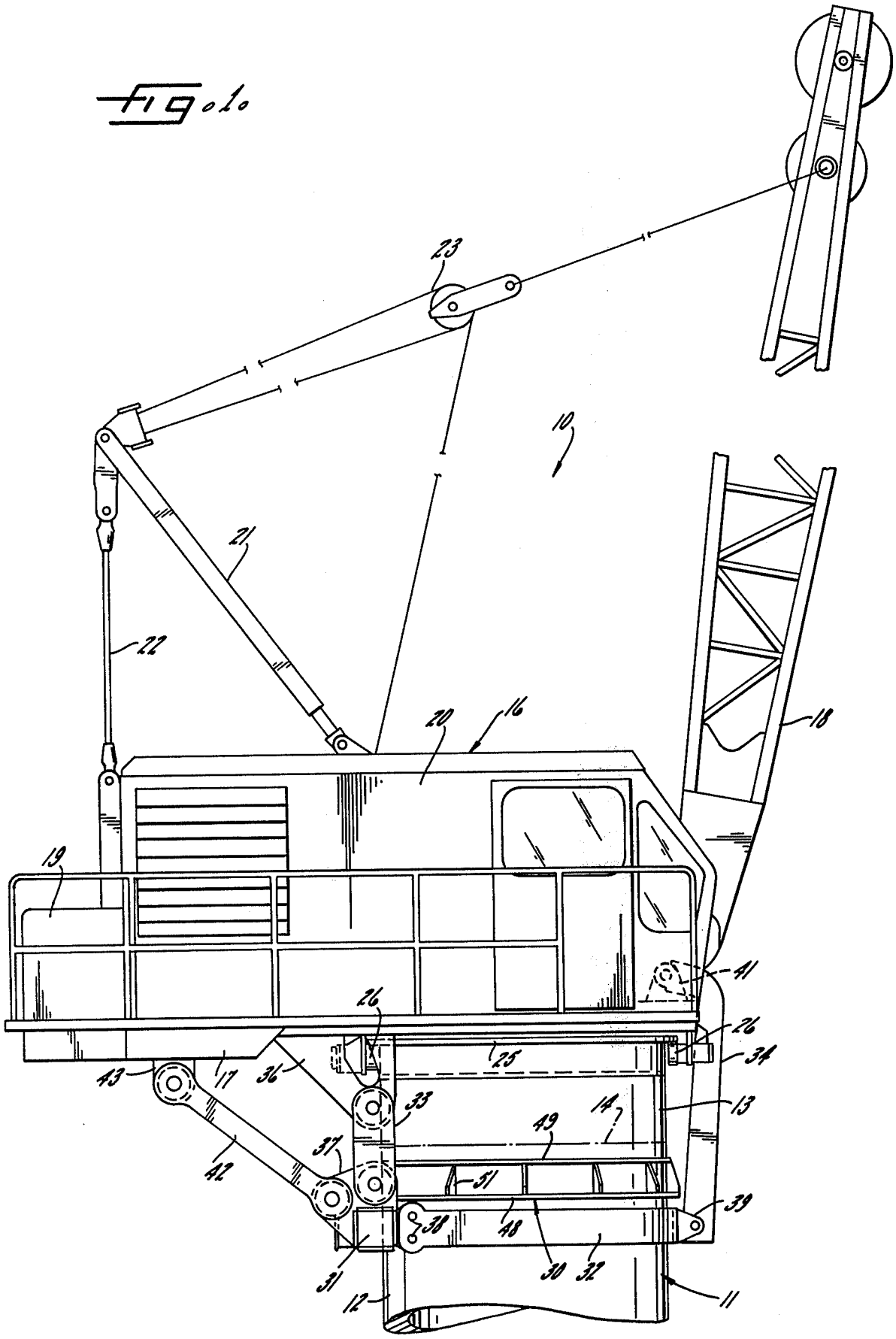
FIG. 1 is a fragmentary side elevation of a sea crane embodying the present invention.
Figure 2:
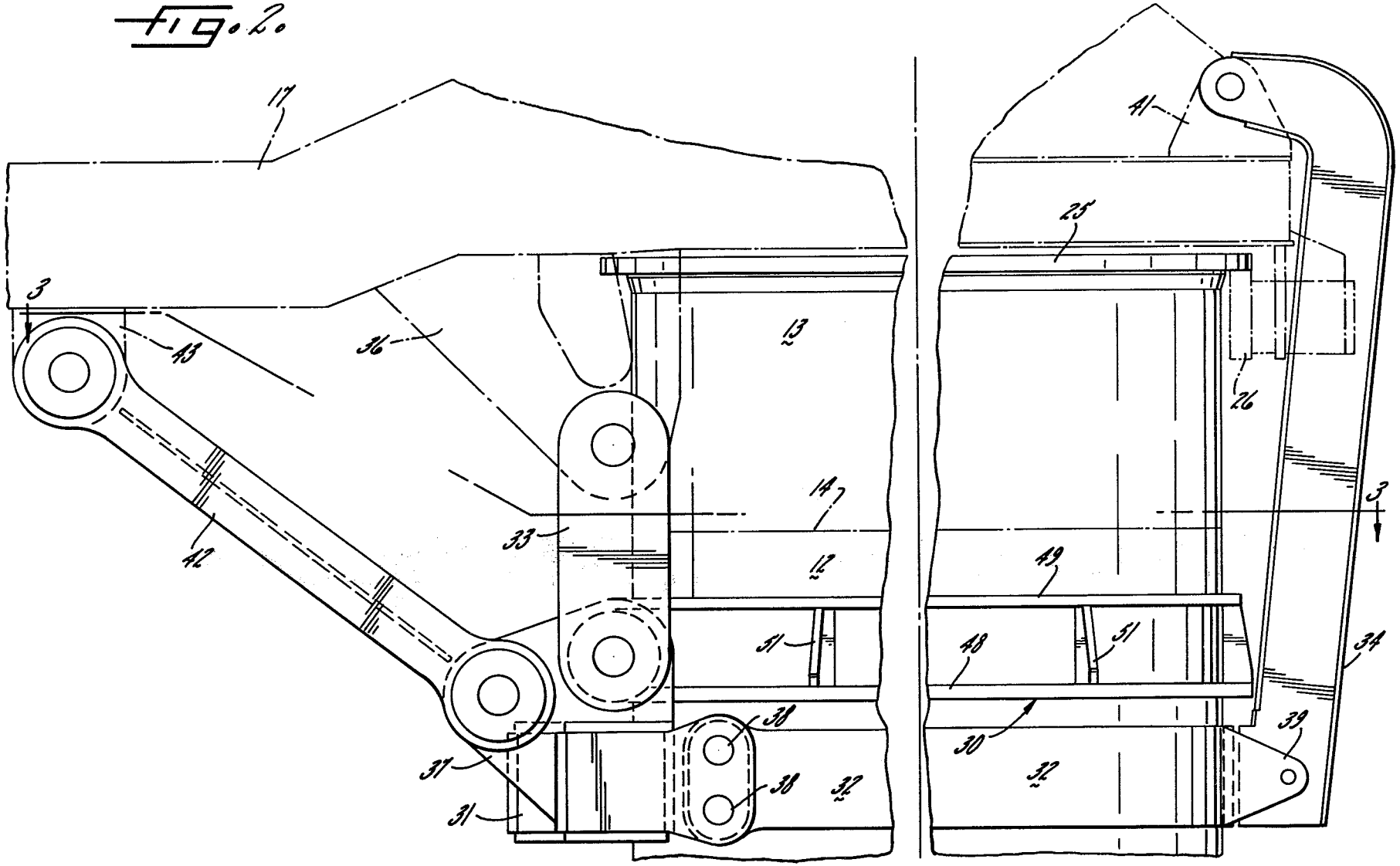
FIG. 2 is a fragmentary enlarged elevation of a portion of the structure shown in FIG. 1.
Figure 3:
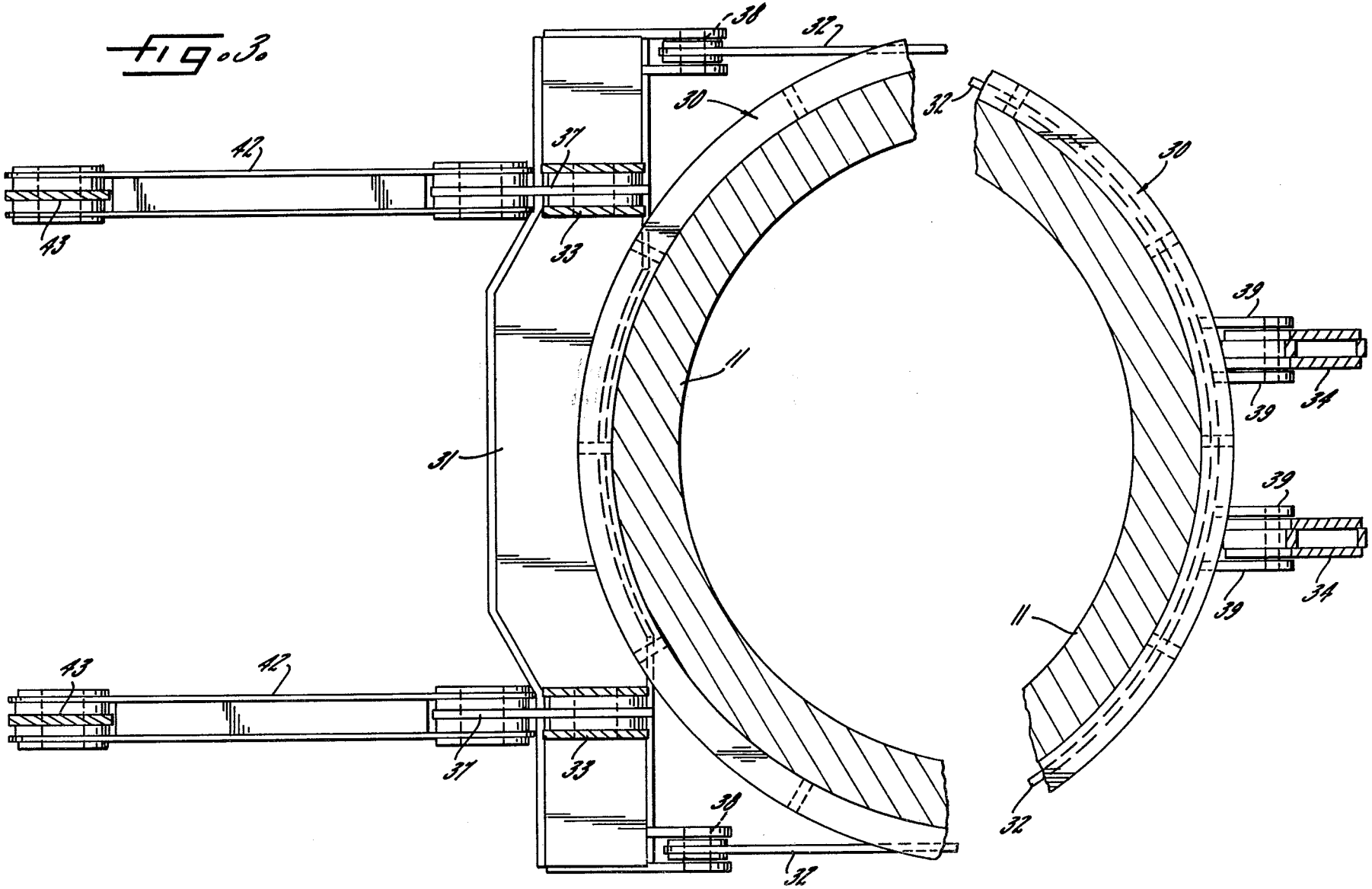
FIG. 3 is a fragmentary section taken approximately along the line 3—3 in FIG. 2.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning to the drawings, there is shown a sea crane 10 mounted on a cylindrical pedestal 11 formed of a lower part 12 constituting an element of the base structure, such as an offshore drilling platform, and an upper part 13 joined integrally with the lower part along a generally horizontal weld line 14. Typically, the crane manufacturer would supply the crane 10 down to and including the upper pedestal part 13 so that the crane is installed by welding the line 14.

The crane 10 includes an upper works 16 having a bed 17 carrying a boom 18 at one end and supporting a counterweight 19 at the other end. A machinery house 20 is also carried on the bed 17, and a gantry 21, backhitch 22 and boom rigging 23 are provided as is conventional. The bed 17 is rotatably mounted on a roller path 25 fixed at the top of the upper pedestal part 13 and, as is also conventional, hook rollers 26 are mounted on the bed 17 so as to engage the underside of the roller path 25 and hold the crane down against the roller path.

As mentioned above, sea cranes have been subjected to unpredicted catastropic loadings causing such failures as upward bending of the rear of counterweight end of the bed so as to send the load supported on the boom out of control; snapping of the hook rollers beneath the rear of the upper works so that the upper works is released from the roller path and toppled forwardly; and, in the event of a sudden loss of a heavy load on the boom, snapping of the front hook rollers when the boom whips back causing the upper works to be carried rearwardly from the pedestal.

In accordance with the invention, an annular collar 30 is fixed around the pedestal 11 well below the roller path 25, and an arcuate stop bar 31 and a strap 32 anchored at its ends to the ends of the stop bar 31 are suspended by tension links to embrace the pedestal 11 and hang beneath the collar 30 but out of contact with both the pedestal and the collar. Preferably, the stop bar 31 is a heavy beam-like structure held on the side of the pedestal 11 opposite the boom 18 by a pair of double tension links 33 extending from lugs 36 on the bed 17 to lugs 37 on the bar 31. The strap 32, anchored to the bar 31 by pins 38, is suspended by a pair of double tension links 34 pinned to lugs 39 on the strap and hooked over to be pinned to lugs 41 on the bed 17 adjacent the foot of the boom 18.

To prevent that form of failure in which the counterweight carrying end of the bed 17 bends upwardly, an additional pair of double tension links 42 extend from the stop bar lugs 37 to lugs 43 at the rear or counterweight end of the bed 17. So as to avoid a catastrophic failure as a result of separation of the pedestal parts along the weld line 14, the collar 30 is located below that weld line. Preferably, the collar 30 itself consists of a weldment made up of a pair of spaced annular rings 48 and 49 reinforced and stiffened by a plurality of ribs 51.

Operation of those parts described will be readily apparent to those skilled in the art. Under normal crane operation, the stop bar 31 and the collar 32 are not in rubbing or rolling engagement with either the pedestal 11 or the collar 30, and the conventional crane parts operate conventionally. By so positioning and proportioning the safety tiedown elements no additional lubrication or other maintenance is required as a result of their presence.

In the event of some catastrophic load causing failure of the normal crane components, such as snapping of either the forward or rearward sets of hook rollers 26, tilting of the crane bed 17 would be abruptly halted by engagement of either the stop bar 31 or the strap 32, or both, with the collar 30. Upward bending movement of the bed 17 would be quickly resisted by the tension links 42 pulling the stop bar 31 into abutting engagement with the collar 30. Even in the unlikely event that the entire top of the pedestal 11 snaps, as along the weld line 14, the upper works of the crane will still be firmly restrained by the interengagement of the collar 30, stop bar 31 and strap 32.

It can thus be seen that a safety device has been provided for the sea crane 10 to prevent loss of life and major damage as a result of catastrophic failure, and that the device, as will be appreciated by those skilled in the art, can be both economically manufactured and installed on either new sea crane installations or attached to existing sea cranes.

We claim as our invention:

1. In a sea crane including a cylindrical pedestal supporting a roller path on which is rotatably mounted an upper works having a bed carrying a boom at one end and supporting a counterweight at the other end, the improvement comprising, in combination, an annular collar fixed around said pedestal well below said roller path, an arcuate stop bar suspended from said bed so as to hang beneath said collar and adjacent said pedestal, said bar being out of contact with both said pedestal and said collar and being on the side of the pedestal opposite said boom, a strap anchored at its ends to the ends of said bar and embracing said pedestal beneath said collar, said strap being out of contact with both said pedestal and said collar, and a plurality of tension links coupling said bed and both said bar and said strap so that, in the event of structural failure, said upper works cannot be pulled or tilted beyond the points where said stop bar or said strap engage said collar.

2. The combination of claim 1 in which said links include sets of vertical links between said bed and both said bar and said strap, and said links also include additional links coupling said bar and the end of the bed supporting said counterweight so as to restrain, upon engagement of said bar and said collar, upward bending movement of the counterweight end of said bed.

3. The combination of claim 1 in which said pedestal consists of an upper part carrying said roller path and a lower part joined integrally with said upper part along a generally horizontal weld line, said collar being positioned below said weld line.

* * * * *